US008308492B2

(12) United States Patent
Takeuchi et al.

(10) Patent No.: US 8,308,492 B2
(45) Date of Patent: Nov. 13, 2012

(54) BOARD-TO-BOARD CONNECTOR

(75) Inventors: Ryotaro Takeuchi, Kanagawa (JP); Koji Yamane, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 13/002,104

(22) PCT Filed: Jul. 2, 2009

(86) PCT No.: PCT/US2009/049591

§ 371 (c)(1),
(2), (4) Date: Mar. 16, 2011

(87) PCT Pub. No.: WO2010/003100

PCT Pub. Date: Jan. 7, 2010

(65) Prior Publication Data

US 2011/0165797 A1 Jul. 7, 2011

(30) Foreign Application Priority Data

Jul. 2, 2008 (JP) ..... 2008-172956

(51) Int. Cl.
*H01R 12/00* (2006.01)

(52) U.S. Cl. ..... 439/74

(58) Field of Classification Search ..... 439/74, 439/660, 83

See application file for complete search history.

(56) References Cited

U.S. PATENT DOCUMENTS 7,070,424 B2 * 7/2006 Obikane et al. ..... 439/74
2008/0124977 A1 5/2008 Peng et al.

FOREIGN PATENT DOCUMENTS

| | | |
|---|---|---|
| EP | 1 798 825 A2 | 6/2007 |
| JP | 10-022015 | 1/1998 |
| JP | 2006-210206 | 8/2006 |
| JP | 2007-018993 | 1/2007 |
| JP | 2007-042468 | 2/2007 |

* cited by examiner

*Primary Examiner* — Alexander Gilman
(74) *Attorney, Agent, or Firm* — Timothy M. Morella

(57) ABSTRACT

The board-to-board connector has a configuration in which first stage fitting guides (18*a*) are arranged on an inner end of side wall portions (14) of a first housing (11) of a first connector (1), an island portion (13) is arranged in a concave portion (12*a*) surrounded by the side wall portions, second stage fitting guides (22*a*) are arranged on four corners of the first housing, fitting surfaces (18) of the side wall portions are at the same surface as a fitting surface of the island portion, and a gap between the fitting guides on both side wall portions is set to a predetermined value. Owing to this configuration, a fumbling tight-fitting operation is made easy, and it is thus possible to complete the tight-fitting operation in a short period of time and in an accurate manner. Accordingly, it is possible to provide a board to board connector which has good operability and high reliability.

14 Claims, 12 Drawing Sheets

BOARD-TO-BOARD CONNECTOR

BACKGROUND OF THE PRESENT INVENTION

1. Field of the Invention

The Present Invention relates, generally, to a board-to-board connector, and, more particularly, to a board-to-board connector allowing for tight-fitting workability.

2. Description of the Related Art

Typically, a board-to-board connector may be used to electrically connect a pair of parallel circuit boards. Such board-to-board connectors are attached, preferably by tight fitting means, to respective opposing surfaces of a pair of circuit boards so that they are electrically connected to each other. An example of such a board-to-board connector is illustrated in Japanese Patent Application No. 8-148240. Further, FIG. 12 illustrates a perspective view of the plug connector of a conventional board-to-board connector. As shown, plug connector 801 is attached to a first circuit board (not illustrated) and tightly fit so as to be engaged with a receptacle connector attached to a second circuit board (not illustrated). Plug connector 801 is provided with plurality of terminals 861 fitted in plug housing 811, which is formed of an insulating material. Tail portions 862 are connected to the first circuit board.

Slope surface 814*a* is formed on an inner end of an upper surface of side wall portions 814 so that a receptacle housing of a receptacle connector (not illustrated) can be smoothly guided into plug housing 811. Thus, when plug connector 801 is tightly fit so as to be engaged with the receptacle connector, it is possible to insert the receptacle housing into plug housing 811 of plug connector 801 in an easy manner. Thus, the tight-fitting workability is improved.

However, in the conventional board-to-board connector, it can be difficult to perform the tight-fitting operation, as it takes a long period of time. Specifically, when plug connector 801 and the receptacle connector, attached respectively to the circuit boards, are tightly fit to each other, depending on the working conditions, an operator might have to perform the tight-fit operation while unable to see a fitting surface of plug housing 811 and the receptacle housing. In such a case, the operator may fumble around to adjust the posture of the receptacle housing relative to plug housing 811, so that the fitting surface of the receptacle housing can be made to slide on the fitting surface of plug housing 811, and so that the receptacle housing is received in plug housing 811. However, as is obvious from FIG. 12, only slope surface 814*a* is formed on the fitting surface, i.e., the upper surface, of plug housing 811. Therefore, when the fitting surface of the receptacle housing is made to slide on the fitting surface of plug housing 811, plug housing 811 and the receptacle housing may be greatly misaligned with each other, or, alternatively, a portion of the receptacle housing may enter into plug housing 811. Thus, the receptacle housing and plug housing 811 may be caught at each other. As a result, the tight-fitting operation cannot be performed in an easy manner, and may take a long period of time.

SUMMARY OF THE PRESENT INVENTION

Therefore, it is an object of the Present Invention to obviate the above-described problems encountered by the conventional board-to-board connector, and to provide a board-to-board connector having good operability and high reliability. According to the Present Invention, first stage fitting guides are arranged on an inner end of side wall portions of a first housing of a first connector, an island portion is arranged in a concave portion surrounded by the side wall portions, second stage fitting guides are arranged on four corners of the first housing, fitting surfaces of the side wall portions are at the same surface as a fitting surface of the island portion, and a gap between the fitting guides on both side wall portions is set to a predetermined value, so that a tight-fitting operation is made easy, and it thus becomes possible to complete the tight-fitting operation in a short period of time and in an accurate manner.

Therefore, a board-to-board connector according to the Present Invention includes a first connector having a first housing having first terminals mounted therein, and a second connector configured to be tightly fit to the first connector, and having a second housing having second terminals fitted therein. The first housing comprises an island portion, concave insertion portions formed at sides of the island portion and side wall portions formed at sides of the concave insertion portions. The second housing comprises a recessed groove portion in which the island portion is inserted and protrusive convex portions formed at both sides of the recessed groove portion to be inserted in the concave insertion portions. First stage fitting guides are formed on inner ends of fitting surfaces of the side wall portions, and second stage fitting guides are formed on portions of the fitting surfaces at both ends of the side wall portions to be disposed outside the first stage fitting guides. The fitting surfaces of the side wall portions are at the same surface as a fitting surface of the island portion. Finally, a distance from the second stage fitting guides on either left or right side to an opposite lateral surface of the island portion is longer than a distance from an outer lateral surface of each of the protrusive convex portions on either left or right side to an inner lateral surface of each of the protrusive convex portions on the other side.

In the board-to-board connector according to a further embodiment of the Present Invention, the fitting surfaces of the side wall portions and the island portion are flat, and none of the portions of the first terminals protrude out from the fitting surfaces, and wherein fitting surfaces of the protrusive convex portions are flat, and none of the portions of the second terminals protrude out from the fitting surfaces.

In the board-to-board connector according to a further embodiment of the Present Invention, the first stage fitting guides are chamfered portions formed in the inner ends of the fitting surfaces, and the second stage fitting guides are chamfered portions formed in inner ends of projecting portions formed on the fitting surfaces.

In the board-to-board connector according to a further embodiment of the Present Invention, when the fitting surfaces of the protrusive convex portions on the either left or right side are brought into abutting contact with the fitting surfaces of the side wall portions, the fitting surfaces of the protrusive convex portions on the other side make abutting contact with the fitting surface of the island portion.

In accordance with the Present Invention, the board-to-board connector has a configuration in which first stage fitting guides are arranged on an inner end of side wall portions of a first housing of a first connector, an island portion is arranged in a concave portion surrounded by the side wall portions, second stage fitting guides are arranged on four corners of the first housing, fitting surfaces of the side wall portions are at the same surface as a fitting surface of the island portion, and a gap between the fitting guides on both side wall portions is set to a predetermined value. Owing to this configuration, a fumbling tight-fitting operation is made easy, and it is thus possible to complete the tight-fitting operation in a short period of time and in an accurate manner. Accordingly, it is possible to provide a board-to-board connector which has good operability and high reliability.

BRIEF DESCRIPTION OF THE FIGURES

The organization and manner of the structure and operation of the Present Invention, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

Figure 1:
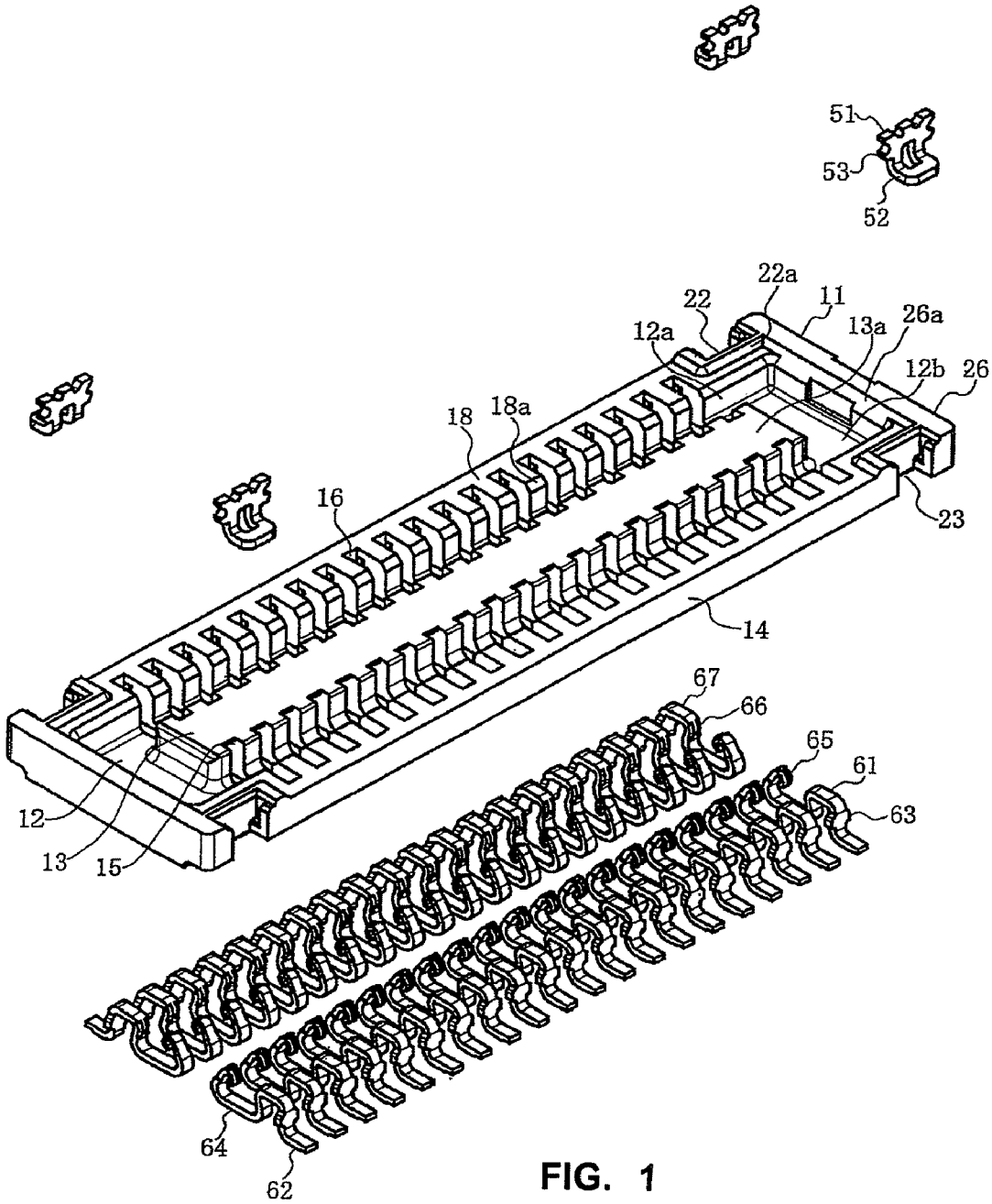
FIG. 1 is an exploded view of a first connector according to the Present Invention.
Figure 2:
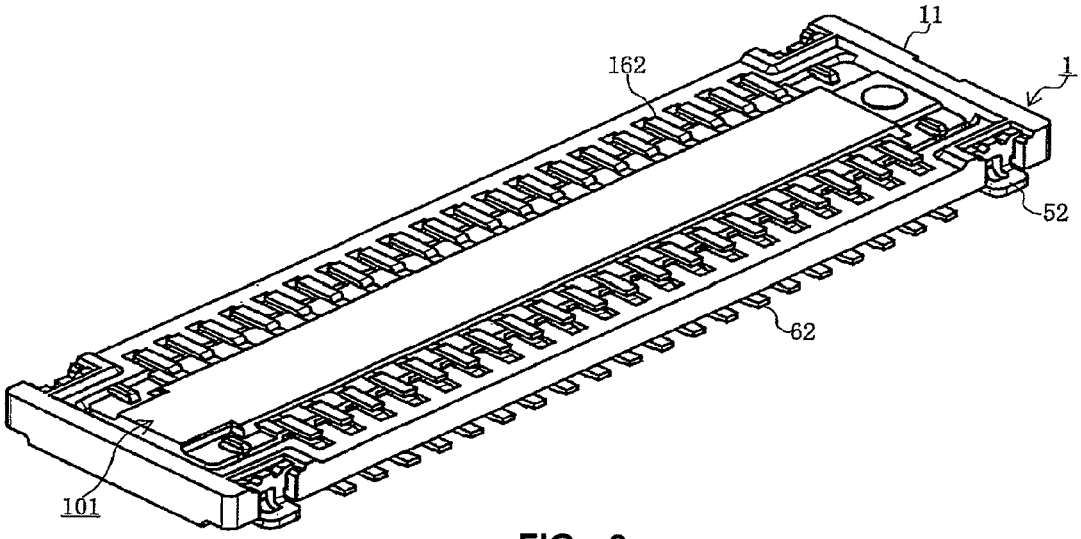
FIG. 2 is a perspective view of the connector of FIG. 1, illustrating a state where the first connector is tightly fit to a second connector, viewed from a fitting surface of the first connector.
Figure 3:
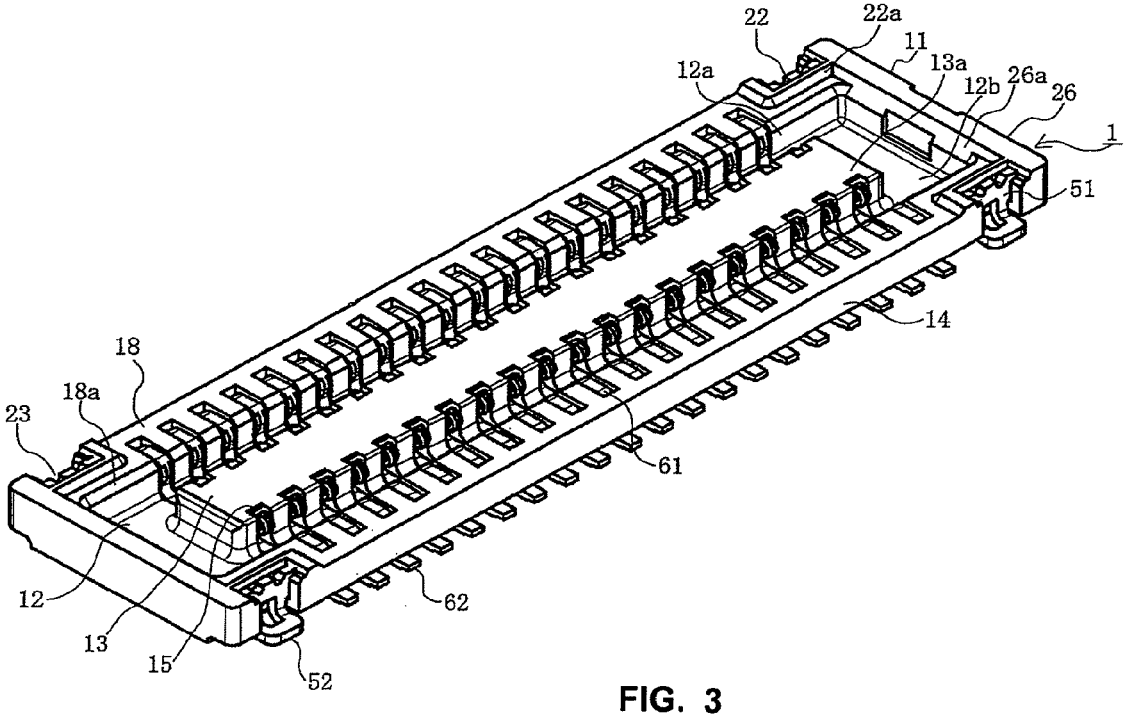
FIG. 3 is a perspective view of the connector of FIG. 1, viewed from a fitting surface.
Figure 4:
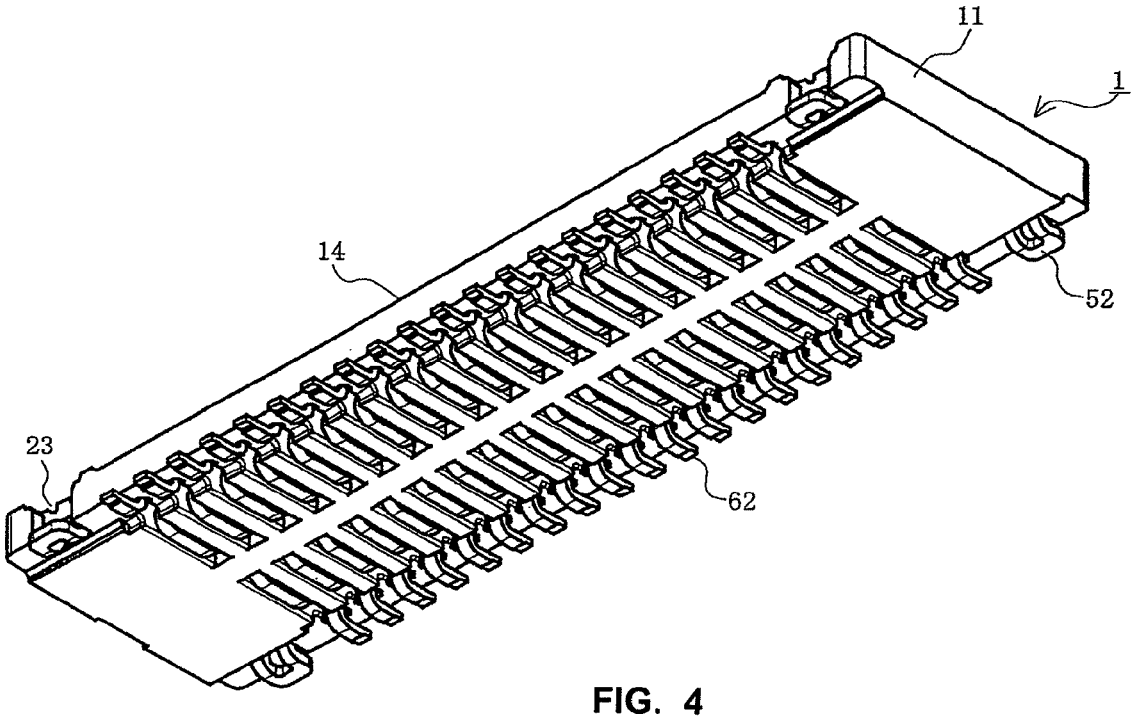
FIG. 4 is a perspective view of the connector of FIG. 1, viewed from a mounting surface.

While the Present Invention may be susceptible to embodiment in different forms, there is shown in the Figures, and will be described herein in detail, specific embodiments, with the understanding that the discussion herein is to be considered an exemplification of the principles of the Present Invention, and is not intended to limit the Present Invention merely to that as illustrated. Further, in the embodiments illustrated in the Figures, representations of directions such as up, down, left, right, front, rear and the like, used for explaining the structure and movement of the various elements of the Present Invention, are not absolute, but relative. These representations are appropriate when the elements are in the position shown in the Figures. If the description of the position of the elements changes, however, it is assumed that these representations are to be changed accordingly.

Referring to FIGS. 1-4, first connector 1, as one of a pair of board-to-board connectors according to the Present Invention, is preferably a surface-mounted connector, and is mounted on a surface of first board 91. Moreover, a second connector 101, as the other one of the pair, is also preferably a surface-mounted connector, and is mounted on a surface of second board 191. The board-to-board connector of the Present Invention includes first connector 1 and second connector 101, and is configured to electrically connect first board 91 with second board 191. Preferably, first and second boards 91, 191 are typical printed circuit boards used in an electronic device or apparatus; alternatively, first and second boards 91, 191 may be any type of board.

First connector 1 includes first housing 11, a connector body integrally formed of an insulating material. As is understood from the Figures, first housing 11 is preferably a generally rectangular, parallelepiped member having a generally rectangular, thick plate-like shape. Concave portion 12, having a generally rectangular shape having a surrounded perimeter is formed on a surface, i.e., a fitting surface (the upper surface in FIGS. 1, 3), on a side where second connector 101 is fitted. Preferably, but not exclusively, first connector 1 has a dimension of about 10.0 mm in length, about 2.5 mm in width and about 1.0 mm in thickness.

Moreover, protrusive convex portion 13, an island portion, is formed in concave portion 12 to be integral with first housing 11. Furthermore, side wall portions 14, configured to extend parallel to protrusive convex portion 13, are formed at both sides of protrusive convex portion 13 to be integral with first housing 11. Thus, protrusive convex portion 13 and side wall portions 14 protrude upwardly from the surface of concave portion 12 and extend in the long-axis direction of first housing 11. Owing to this configuration, recessed groove portions 12*a* of concave portion 12, being elongated concave insertion portions configured to extend in the long-axis direction of first housing 11, are formed at both sides of protrusive convex portion 13 so as to be disposed between protrusive convex portion 13 and side wall portions 14. Although, as illustrated, protrusive convex portion 13 is singular in number, a plurality of protrusive convex portions 13 may be provided. In addition, protrusive convex portion 13 has a dimension of about 0.6 mm in width, for example; the dimension may be appropriately changed.

In the Present Invention, first groove-shaped terminal receiving cavities 15 are formed along the lateral surfaces at both sides of protrusive convex portion 13 and the bottom surfaces of recessed groove portions 12*a* in order to receive therein first terminals 61. Preferably and for example, the number of first terminal receiving cavities 15 formed on each of surface is 20, with a pitch of about 0.4 mm. Moreover, the number of first terminals 61 arranged on each surface is also, preferably, 20, with a pitch of about 0.4 mm, for example. Further, first terminal receiving grooves 16 are formed on portions of inner lateral surfaces of side wall portions 14, and are disposed at positions corresponding to respective terminal receiving cavities 15. First terminal receiving cavities 15 and first terminal receiving grooves 16 function as a series of grooves for receiving first terminals 61. It is also to be noted that the pitch and the number of terminal receiving cavities 15, first terminal receiving grooves 16 and first terminals 61 is not set by the numeric examples herein, and may be appropriately changed.

First terminals 61 are integral members formed by applying, e.g., punching and bending, to a conductive metallic plate. Each first terminal 61 is provided with holding portion 63, tail portion 62 connected to a lower end of holding portion 63, upper connection portion 67 connected to an upper end of holding portion 63, second contact portion 66 formed in the vicinity of an inner end of upper connection portion 67, lower connection portion 64 connected to second contact portion 66 and first contact portion 65 formed in the vicinity of a free end of lower connection portion 64.

Holding portions 63 extend in the up-down direction, i.e., in the thickness direction, of first housing 11. Tail portions 62 are connected to holding portions 63 and extend in the left-right direction, i.e., outwardly in the width direction of first housing 11 so as to be connected to connection pads connected to a conductive trace on the first board 91 by means of soldering or the like. Upper connection portions 67 are connected to holding portions 63 and extend inwardly in the width direction of first housing 11. Moreover, second contact portions 66, having a curved shape and configured to downwardly bend and inwardly protrude, are formed at the inner ends of upper connection portions 67. Lower connection portions 64 are generally U-shaped portions connected to the lower ends of second contact portions 66. Furthermore, first contact portions 65 are curved and configured to bend into a U shape, and outwardly protrude to be formed at the free ends, i.e., in the vicinity of the inner upper ends of lower connection portions 64. First terminals 61 are preferably fitted into first terminal receiving cavities 15 and first terminal receiving grooves 16 from the side of a mounting surface, so as to be fixed at first housing 11 with holding portion 63 disposed between the side walls of first terminal receiving grooves 16.

Moreover, end wall portions 26, extending in a short-axis direction of first housing 11, are arranged at both ends in the long-axis direction of first housing 11, and both ends of end wall portions 26 are connected to both ends in the long-axis direction of side wall portions 14. Furthermore, end wall chamfered portions 26*a* are formed on inner circumferential ends of end wall portions 26. In addition, concave end portions 12*b* are formed on portions of concave portion 12 disposed outside both ends in the long-axis direction of protrusive convex portion 13 surrounded by end wall portions 26 and side wall portions 14. In other words, concave end portions 12*b* are formed outside both ends of recessed groove portions 12*a*. Concave end portions 12*b* are portions to which convex insertion portion 112*b* of second connector 101 is inserted in a state where first and second connectors 1, 101 are tightly fitted thereto, and portions to which first reinforcing brackets 51 are attached.

First reinforcing brackets 51 are a J-shaped integral member, formed by applying, e.g., punching and bending, to a metallic plate. Each first reinforcing bracket 51 includes holding portion 53 and tail portion 52 connected to the lower end of holding portion 53. First reinforcing brackets 51 are received and held in concave bracket holding portions 23 formed in first housing 11. Concave bracket holding portions 23 are formed on portions of outer lateral surfaces disposed in the vicinity of both ends in the long-axis direction of side wall portions 14. First reinforcing brackets 51 are held by holding portions 53 being sandwiched by the lateral walls of concave bracket holding portions 23. Tail portions 52 are connected to fixing pads on first board 91 by means of soldering or the like.

In the Present Invention, fitting surfaces 18, i.e., the upper surfaces of side wall portions 14 on both sides, are preferably configured to be flat or smooth. First chamfered portions 18*a*, as first stage fitting guides, are formed at inner circumferential ends of side wall portions 14; i.e., at the inner ends of fitting surfaces 18. Moreover, no portion of first terminals 61, fixed at first housing 11, protrude out from fitting surfaces 18. Furthermore, projecting portions 22, projecting upward and surrounding the perimeter of concave bracket holding portion 23, are formed on portions of fitting surfaces 18 disposed in the vicinity of the ends of side wall portions 14 in the long-axis direction. Second chamfered portions 22*a*, as second stage fitting guides, are formed on the inner ends of projecting portions 22; i.e., the inner ends of the upper surfaces of projecting portions 22. Therefore, at four corners of first housing 11, specifically, in the vicinity of both ends of opposing side wall portions 14 in the long-axis direction, the fitting guides are arranged into two stages with flat fitting surfaces 18 disposed therebetween.

Fitting surface 13*a*, the upper surface of protrusive convex portion 13, is configured as a flat or smooth surface and formed at the same height and at the same surface as fitting surfaces 18. That is, a plane containing fitting surface 13*a* is the same as a plane containing fitting surfaces 18. Further, no portion of first terminals 61 protrude out from fitting surface 13*a*.

Figure 5:
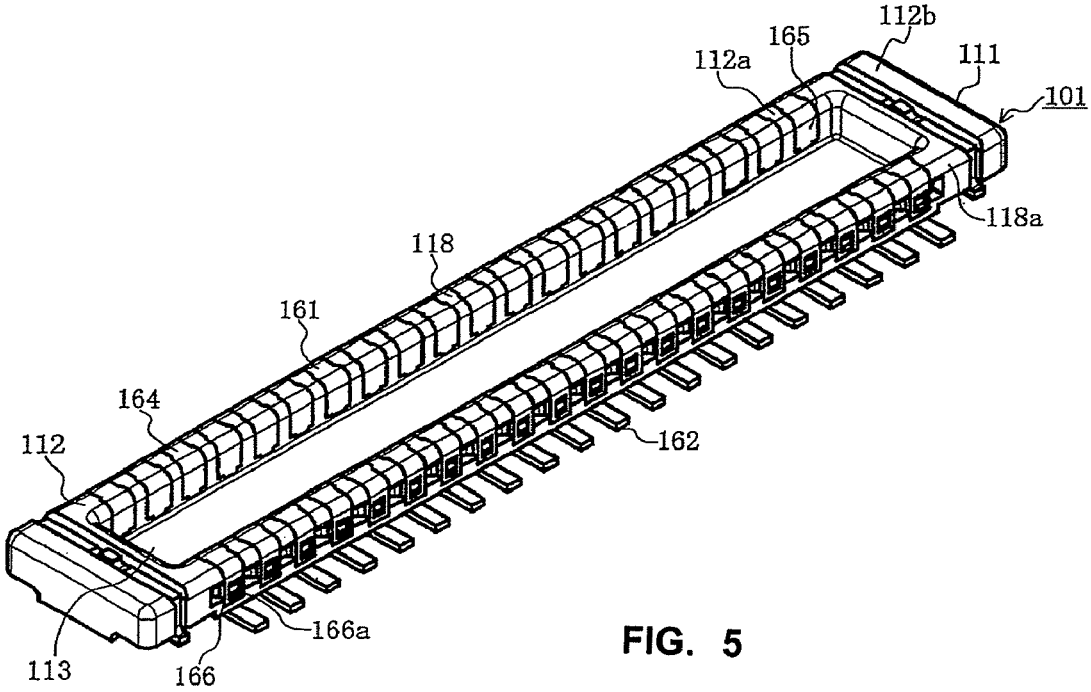
FIG. 5 is a perspective view of the second connector of FIG. 2, viewed from a fitting surface.
Figure 6:
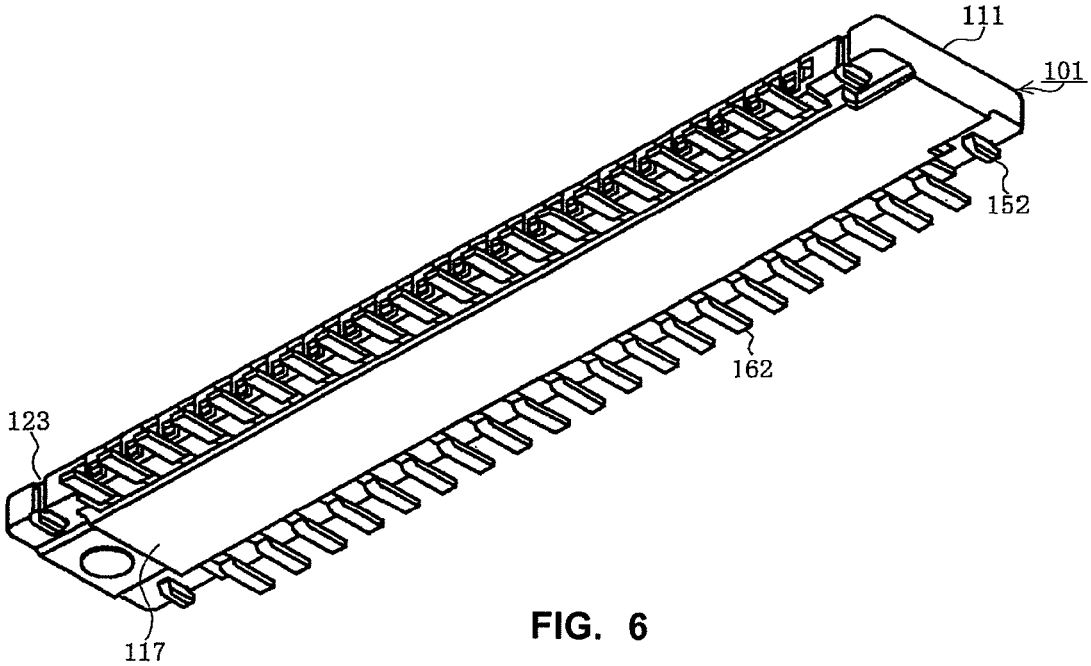
FIG. 6 is a perspective view of the connector of FIG. 2, viewed from a mounting surface.
Figure 7:
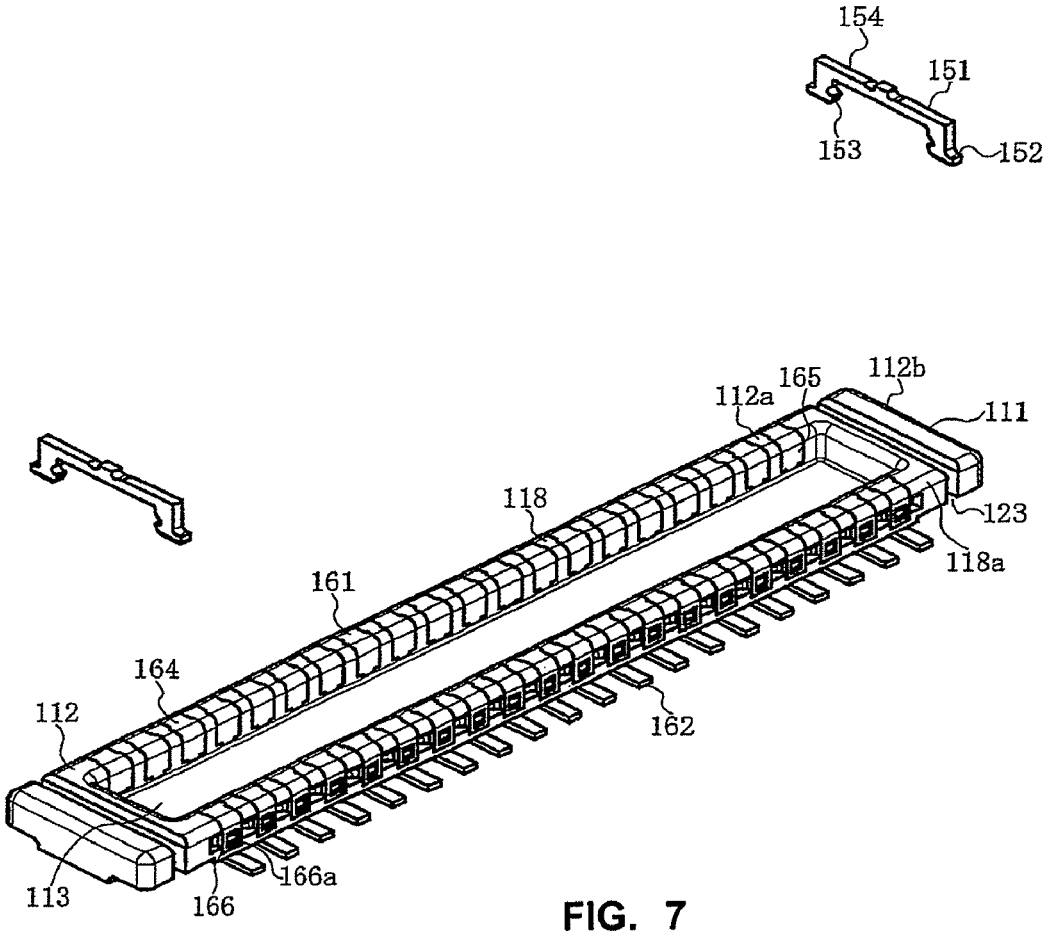
FIG. 7 is an exploded view of the connector of FIG. 2.

With respect to FIGS. 5-7, a description of a structure of the second connector 101 will be provided. Similar to first connector 1, second connector 101 includes second housing 111, a connector body integrally formed of an insulating material. As is understood from the Figures, second housing 111 is preferably a generally rectangular, parallelepiped member having a generally rectangular, thick plate-like shape. Preferably, but not exclusively, second housing 111 has a dimension of about 8.0 mm in length, about 1.5 mm in width and about 0.8 mm in thickness. Elongated recessed groove portion 113, extending in the long-axis direction of second housing 111, and convex portion 112, configured to surround the perimeter of recessed groove portion 113, are integrally formed on a surface, i.e., a fitting surface (the upper surface in FIG. 5) of second housing 111 on a side where second housing 111 is inserted into first connector 1.

Protrusive convex portions 112*a*, configured to extend in the long-axis direction of second housing 111, is formed along the sides of recessed groove portion 113 along both sides of second housing 111. Second terminals 161 are arranged in protrusive convex portions 112*a*.

As illustrated in FIG. 6, recessed groove portion 113 is closed by bottom plate portion 117 at a surface thereof, i.e., a mounting surface (the lower surface in FIG. 6), where it is mounted on second board 191. Moreover, although as illustrated, the number of protrusive convex portions 112*a* is two, the number is not particularly limited. Preferably, recessed groove portion 113 has a dimension of about 0.7 mm in width, and the dimension thereof may be appropriately changed.

Second terminals 161 are integrally formed by applying, e.g., punching and bending, to a conductive metallic plate. Each second terminal 161 is provided with body portion 163, tail portion 162 connected to a lower end of body portion 163, first contact portion 165 connected to an upper end of body portion 163, connection portion 164 connected to an upper end of first contact portion 165, and second contact portion 166 connected to an outer end of connection portion 164. Moreover, concave contact portions 166*a*, configured to be engaged with first contact portions 65, are formed on the surface of second contact portions 166.

Body portions 163 are portions held with their perimeter being surrounded by second housing 111 (not illustrated in FIGS. 5-7). Tail portions 162 are connected to lower ends of body portions 163 extending in the left-right direction of body portions 163, i.e., in the width direction of second housing 111, so as to extend toward the outside of second housing 111 so as to be connected to connection pads connected to a conductive trace on second board 191 by means of soldering or the like. First contact portions 165 are flat plate-like portions connected to body portions 163 so as to extend in the up-down direction, i.e., in the thickness direction of second housing 111. Connection portions 164 are connected to first contact portions 165 and extend outwardly in the width direction of second housing 111. Second contact portions 166 are portions connected to outer ends of connection portions 164 so as to extend downwardly.

Second terminals 161 are integrated with second housing 111 by means of integral molding. Thus, second terminals 161 are integrally attached to second housing 111 in a state where body portions 163 are buried in second housing 111, and the surfaces of first and second contact portions 165, 166, and connection portions 164, are exposed to the respective lateral surfaces of protrusive convex portions 112*a* and fitting surfaces 118. Preferably, the number of second terminals 161 arranged in second housing 111 is 20, with a pitch of about 0.4 mm, for example. Moreover, the pitch and the number may be appropriately changed.

Moreover, convex insertion portions 112*b*, as a thick end wall portion extending in the short-axis direction, are arranged in the long-axis direction of second housing 111, and both ends of convex insertion portions 112*b* are connected to both ends in the long-axis direction of protrusive convex portions 112*a*. Convex insertion portions 112*b* are portions being inserted in concave end portions 12*b* in a state where first and second connectors 1, 101 are tightly fitted thereto, and portions to which second reinforcing brackets 151 are attached.

Second reinforcing brackets 151 are an integral member having a gate or a U shape in side view, formed by applying, e.g., punching to a metallic plate. Each second reinforcing bracket 151 includes rod-shaped body portion 154, pair of tail portions 152 and holding portions 153. Second reinforcing brackets 151 are received and held in concave bracket holding portions 123 formed in convex insertion portions 112*b*. Tail portions 152 are connected to fixing pads on second board 191 by means of soldering or the like.

In the Present Invention, fitting surfaces 118 being the upper surfaces of protrusive convex portions 112*a* on both sides are at the same surfaces and are configured as a flat or smooth surface. Moreover, chamfered portions 118*a* as the fitting guides are formed at outer circumferential ends of protrusive convex portions 112*a*; that is, at the outer ends of fitting surfaces 118. Moreover, none of the portions of second terminals 161 protrude out from fitting surfaces 118 and chamfered portions 118*a*. Specifically, the surfaces of connection portions 164 of second terminals 161 exposed to fitting surfaces 118 are at the same surface as fitting surfaces 118. Moreover, the surfaces of portions at which second contact portions 166 are connected to connection portions 164 of second terminals 161 being exposed to chamfered portions 118*a* are at the same surface as chamfered portions 118*a*.

With respect to FIGS. 8-11, a description of an operation of tightly fitting the first connector 1 to be engaged with the second connector 101 will be provided. First connector 1 is surface-mounted on first board 91 in a state where tail portions 62 are connected to the conductive trace on first board 91 by means of soldering or the like and tail portions 52 are connected to the fixing pads on first board 91 by means of soldering or the like.

Figure 8:
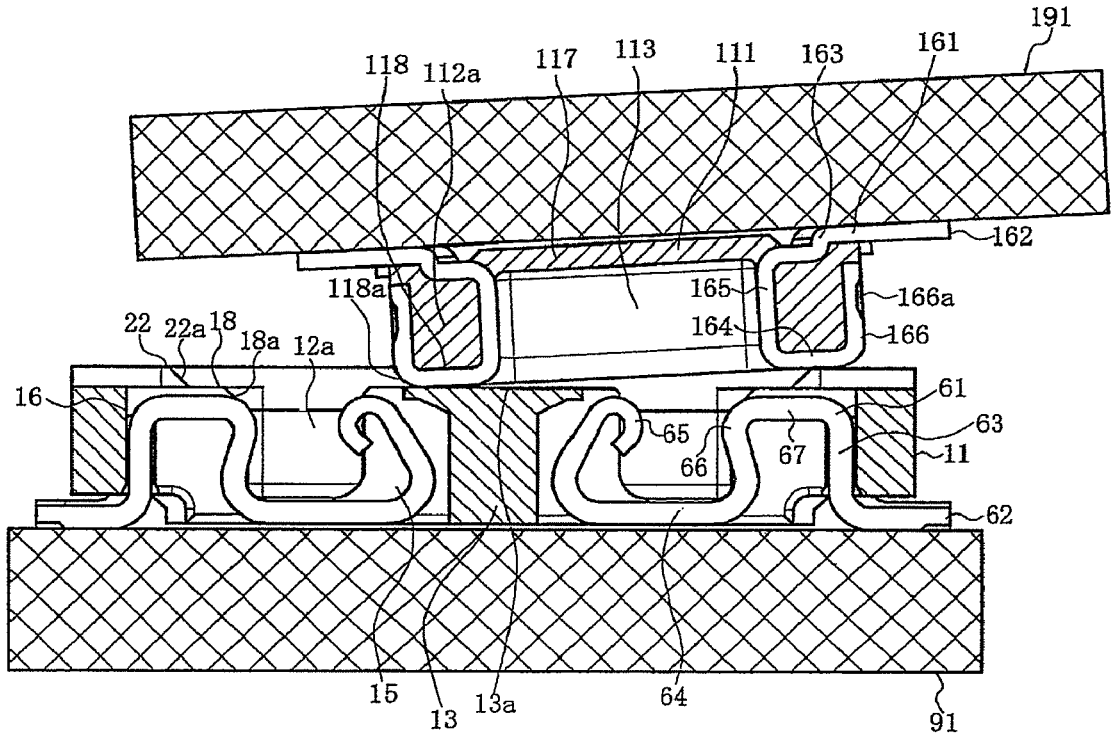
FIG. 8 is a cross-sectional view of the terminals of the connectors, showing a first step of a tight-fitting operation.
Figure 9:
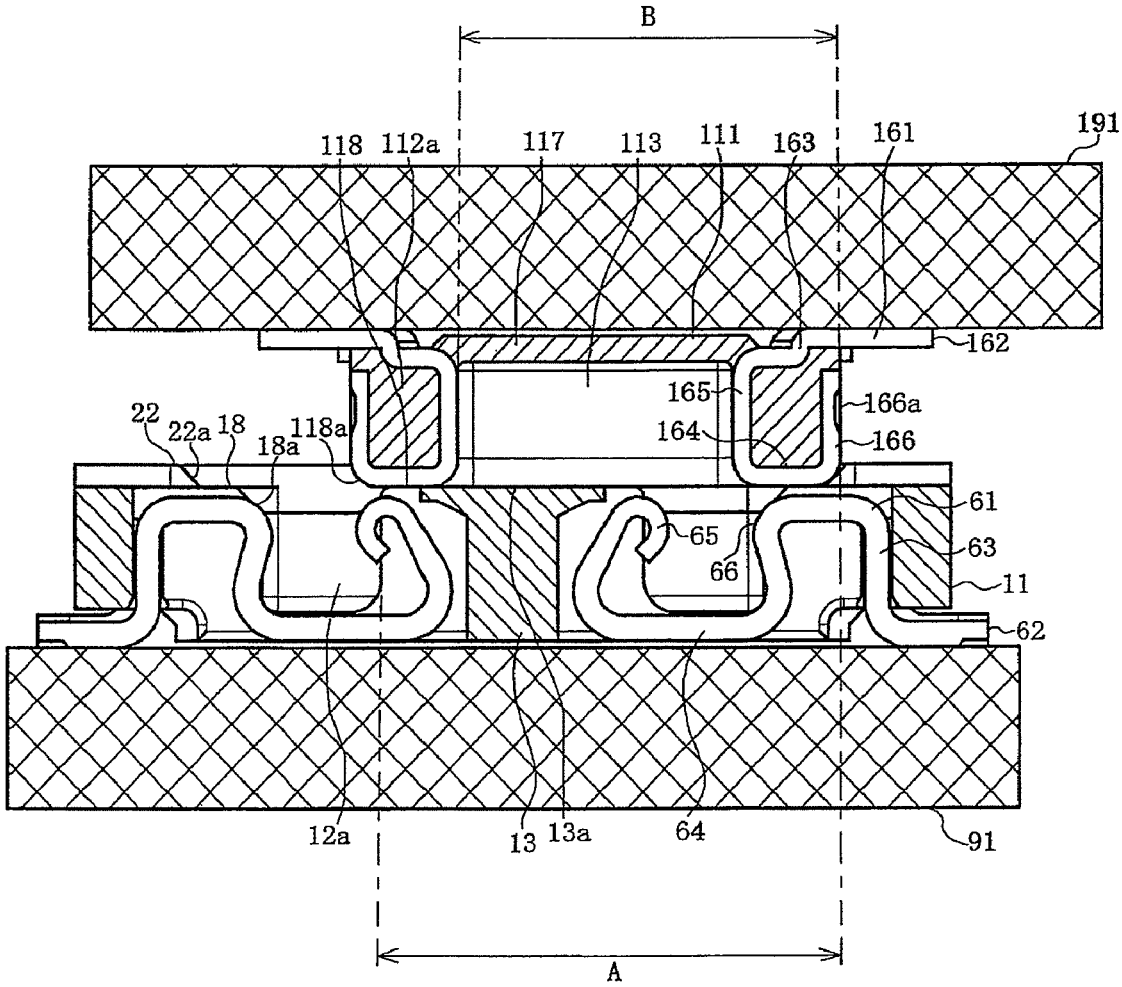
FIG. 9 is a cross-sectional view of the terminals of the connectors, showing a second step of the tight-fitting operation.
Figure 10:
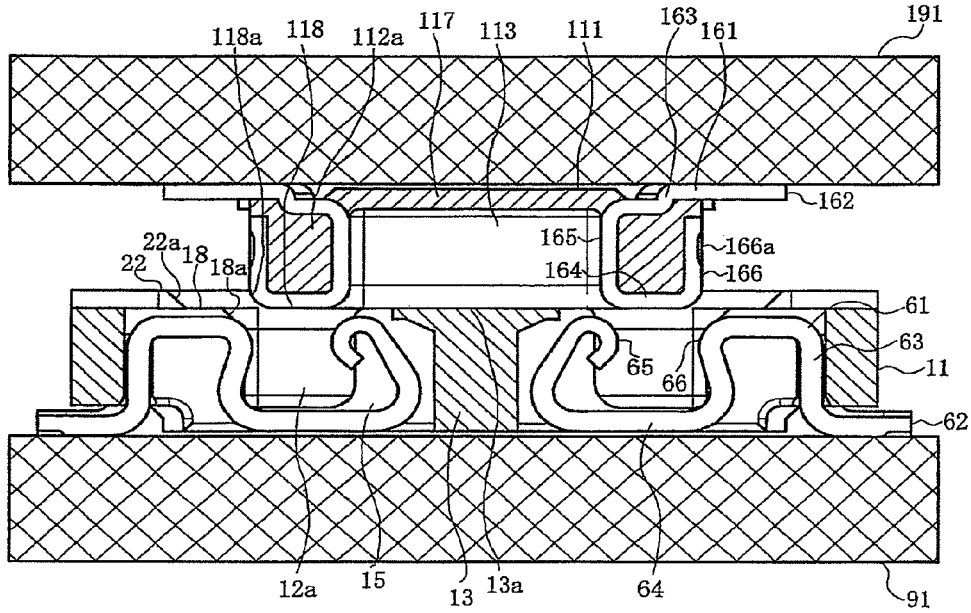
FIG. 10 is a cross-sectional view of the terminals of the connectors, showing a third step of the tight-fitting operation.
Figure 11:
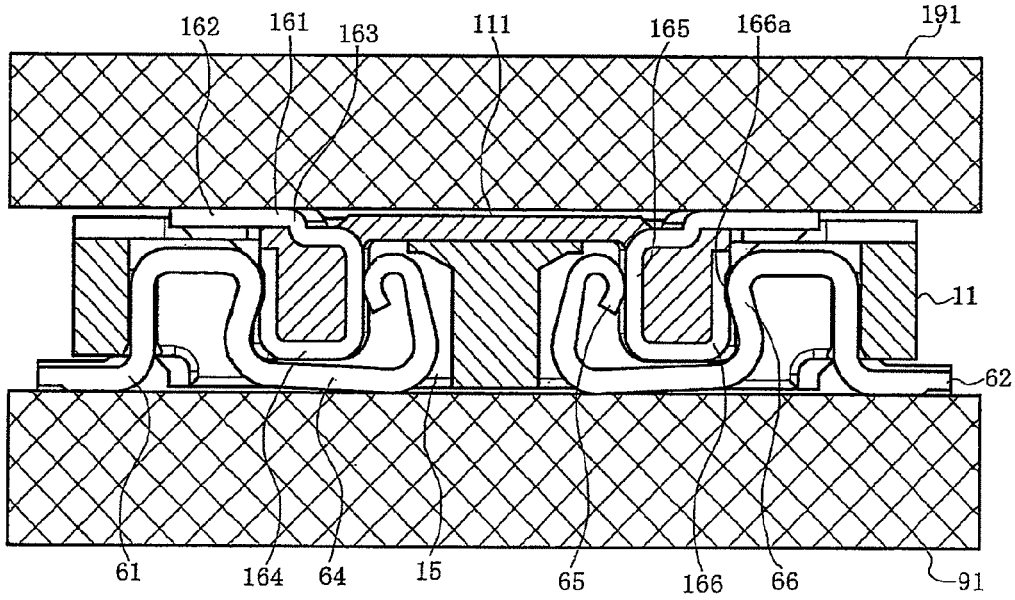
FIG. 11 is a cross-sectional view of the terminals of the connectors, illustrating a state where the connectors are tightly fitted thereto.
Figure 12:
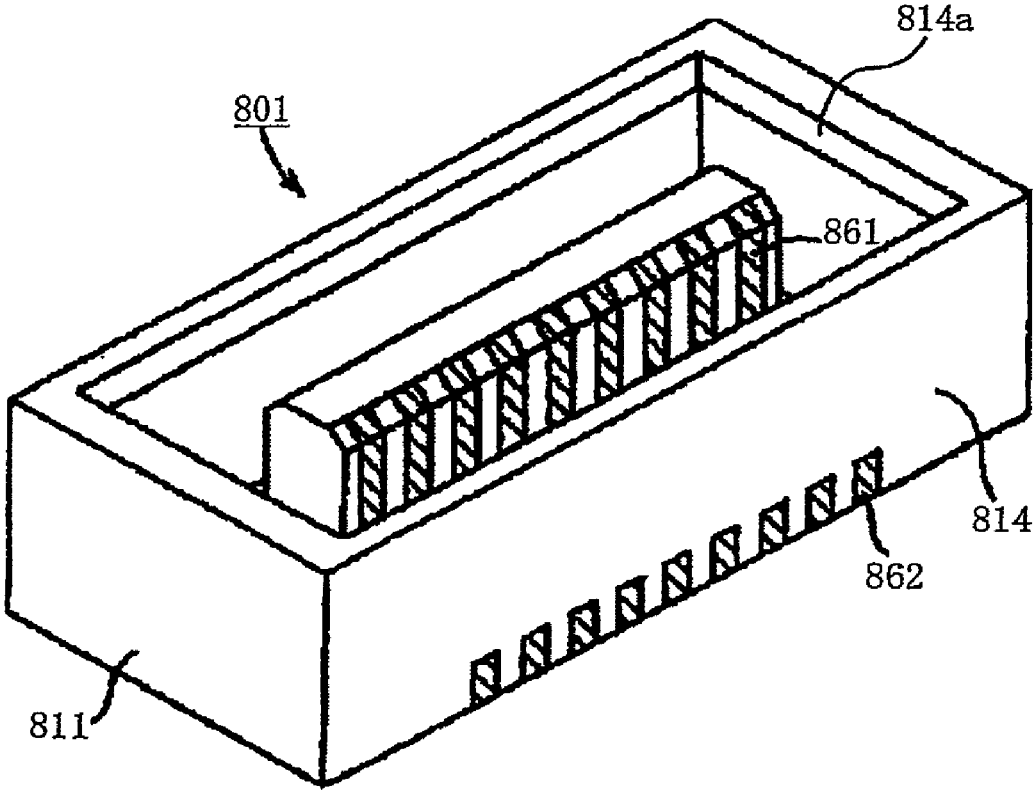
FIG. 12 Prior Art
FIG. 12 is a perspective view of a conventional plug connector of a board-to-board connector.

As illustrated in FIGS. 8-10, the distal ends of second contact portions 66 are projected from first terminal receiving cavities 15 of side wall portions 14 to be inserted into recessed groove portions 12*a*, and the distal ends of first contact portions 65 are projected from first terminal receiving cavities 15 of protrusive convex portion 13 to be inserted into recessed groove portions 12*a*. Thus, as illustrated in FIG. 11, second terminals 161 of second connector 101 inserted into recessed groove portion 12*a* can be sandwiched between first and second contact portions 65, 66. Moreover, first and second contact portions 65, 66 are approximately at the same position in the thickness direction of first housing 11 and oppose each other.

Similarly, second connector 101 is surface-mounted on second board 191 in a state where tail portions 162 of second terminals 161 are connected to the conductive trace on second board 191 by means of soldering or the like and tail portions 152 of second reinforcing brackets 151 are connected to the fixing pads on second board 191 by means of soldering or the like.

As illustrated in FIGS. 8-10, first contact portions 165 are exposed while extending along the inner side walls of protrusive convex portions 112*a*, and second contact portions 166 are exposed while extending along the outer side walls of second protrusive convex portions 112*a*. Moreover, concave contact portions 166*a* are formed on the surfaces of second contact portions 166. Owing to this configuration, as illustrated in FIG. 11, first and second contact portions 165, 166 of second terminals 161 of second connector 101, inserted in recessed groove portions 12*a* can make contact with first and second contact portions 65, 66 of first terminals 61, respectively, first and second contact portions 65, 66 sandwiching second terminals 161. Moreover, since second contact portions 66 of first terminals 61 are engaged with concave contact portions 166*a* of second terminals 161, it is difficult to remove second connector 101 from first connector 1 even upon receipt of a force that releases the tight-fitting between first and second connectors 1, 101; that is, upon receipt of a removal force for removing second connector 101 from second connector 101. That is, a necessary removal force is increased.

The following description focuses on the case where an operator performs a tight-fitting operation while being unable to see the fitting surfaces of first and second connector 1, 101. First, the operator moves first and/or second connector 1, 101 toward either connector in a state where the fitting surface of first connector 1 opposes that of second connector 101 so that the fitting surface of first connector 1 makes abutting contact with that of second connector 101. In this case, since the tight-fitting operation is performed in a fumbling manner, the positioning cannot be performed in an accurate manner. Thus, as illustrated in FIG. 8, the central axis of first connector 1 is greatly misaligned with respect to that of second connector 101. Specifically, fitting surfaces 118 of protrusive convex portion 112*a* on the right side of second connector 101 are in abutting contact with the upper surfaces of projecting portions 22 on the right side of first connector 1, while fitting surfaces 118 of protrusive convex portions 112*a* on the right side of second connector 101 are in abutting contact with fitting surface 13*a* of protrusive convex portion 13 of first connector 1. For this reason, the fitting surface of first connector 1 is not parallel with that of second connector 101, but second board 191 is tilted with respect to first board 91. Therefore, the operator is able to perceive, by way of the fumbling, that first connector 1 is greatly misaligned with respect to second connector 101 and that second connector 101 is on the right side of first connector 1 with respect to the tilting direction of second board 191.

Therefore, the operator displaces second connector 101 toward the left side of first connector 1. Then, as illustrated in FIG. 9, fitting surfaces 118 of protrusive convex portions 112*a* on the right side of second connector 101 are lowered from the upper surfaces of projecting portions 22 on the right side of first connector 1 while being guided by second chamfered portions 22*a* to be brought into abutting contact with fitting surfaces 18 of side wall portions 14. Moreover, in the state illustrated in FIG. 9, chamfered portions 118*a* of protrusive convex portions 112*a* on the right side of second connector 101 are in abutting contact with second chamfered portions 22*a* on the right side of first connector 1. On the other hand, fitting surfaces 118 of protrusive convex portions 112*a* on the right side of second connector 101 are still in abutting contact with fitting surface 13*a* of protrusive convex portion 13 of first connector 1.

Fitting surface 13*a* of protrusive convex portion 13 and fitting surfaces 18 of side wall portions 14 on both side of first connector 1 are on the same surface and flat. Moreover, fitting surfaces 118 of protrusive convex portions 112*a* on both sides of second connector 101 are on the same surface and flat. Therefore, it is possible to perform the positioning between first connector 1 and second connector 101 by moving second connector 101 to be smoothly slid toward the left and right sides of first connector 1 while fitting surfaces 118 of protrusive convex portions 112*a* of second connector 101 being slid on fitting surface 13*a* of protrusive convex portion 13 and fitting surfaces 18 of side wall portions 14 of first connector 1 within a range until chamfered portions 118*a* of protrusive convex portion 112*a* on the left and right sides are brought into abutting contact with second chamfered portions 22*a* on the left and right sides.

In other words, since protrusive convex portions 112*a* having chamfered portions 118*a* formed on fitting surfaces 118 on the left and right sides of second connector 101 are formed, the range of an area on which second connector 101 is slid with respect to first connector 1 is narrowed, and thus, it is possible to perform the positioning in an easy manner. Moreover, since fitting surfaces 18 of side wall portions 14 on both sides of first connector 1 and fitting surface 13*a* of protrusive convex portion 13 are at the same surface and flat, it is possible to move second connector 101 to be smoothly slid with respect to first connector 1.

In addition, as illustrated in FIG. 9, a distance A is set to be longer than a distance B. That is, the distance A from second chamfered portions 22*a* on either left or right side of first connector 1 to the opposite lateral surface of protrusive convex portion 13 is set to be longer than the distance B from the outer lateral surface of each of protrusive convex portions 112*a* on either left or right side of second connector 101 to the inner lateral surface of each protrusive convex portions 112*a*. Therefore, as long as it is within the range until chamfered portions 118*a* of protrusive convex portion 112*a* on the left and right sides are brought into abutting contact with second chamfered portions 22*a* on the left and right sides, fitting surfaces 118 of protrusive convex portions 112*a* on the left and right sides are in abutting contact with fitting surface 13*a* of protrusive convex portion 13 and fitting surfaces 18 of side wall portions 14 without being fitted into the recessed groove portions 12*a*. Therefore, it is possible to move second connector 101 to be smoothly slid with respect to first connector 1. That is, it is possible to perform the positioning while preventing second connector 101 from being caught at first connector 1.

Then, as illustrated in FIG. 10, when the positions of protrusive convex portions 112*a* on the left and right sides of second connector 101 correspond to the positions of recessed groove portions 12*a* on the left and right sides of first connector 1, the positioning between first connector 1 and second connector 101 is completed. In such a state, when second connector 101 is moved downward, as illustrated in FIG. 11, protrusive convex portions 112*a* on the left and right sides of second connector 101 are inserted into recessed groove portions 12*a* on the left and right sides of first connector 1, first contact portions 65 of first terminals 61 make contact with first contact portions 165 of second connector 161, second contact portions 66 of first terminals 61 make contact with second contact portions 166 of second terminals 161, and thus, first connector 1 is tightly fitted to be connected to second connector 101.

In this way, first terminals 61 and second terminals 161 are electrically connected to each other. As a result, the conductive trace connected to the connection pads on first board 91 being connected to tail portions 62 of first terminals 61 are electrically connected to the conductive trace connected to the connection pads on second board 191 being connected to tail portions 162 of second terminals 161. In this case, since first terminals 61 and second terminals 161 make multi-point contact with each other, it is possible to surely maintain stable electrical connection.

Moreover, second contact portions 66 of first terminals 61 are in a state where they are engaged with concave contact portions 166*a* of second contact portions 166 of second terminals 161. Owing to this configuration, it is difficult to remove second connector 101 from first connector 1 even upon receipt of a force that releases the tight-fitting between first connector 1 and second connector 101, that is, upon receipt of a removal force for removing second connector 101 from first connector 1. That is, a necessary removal force is increased.

As described above, in the Present Invention, the board-to-board connector includes first connector 1 having first housing 11 having first terminals 61 mounted therein, first housing 11 comprising: protrusive convex portion 13, recessed groove portions 12*a* formed at both sides of protrusive convex portion 13 and side wall portions 14 formed at both sides of each of recessed groove portions 12*a*; and second connector 101 configured to be tightly fitted to first connector 1, second connector 101 having second housing 111 having second terminals 161 contacted with first terminal 61, second housing 111 comprising: recessed groove portion 113 in which protrusive convex portion 13 is inserted, and protrusive convex portions 112*a* formed at both sides of recessed groove portion 113 to be inserted in recessed groove portions 12*a*, wherein: first chamfered portions 18*a* are formed on the inner ends of fitting surfaces 18 of side wall portions 14, and second chamfered portions 22*a* are formed on portions of fitting surfaces 18 at both ends of side wall portions 14 to be disposed outside first chamfered portions 18*a*; fitting surfaces 18 of side wall portions 14 are at the same surface as fitting surface 13*a* of protrusive convex portion 13; and the distance from second chamfered portions 22*a* on either left or right side to the opposite lateral surface of protrusive convex portion 13 is longer than the distance from the outer lateral surface of each of protrusive convex portions 112*a* on either left or right side to the inner lateral surface of each of protrusive convex portions 112*a* on the other side.

Owing to this configuration, the fumbling tight-fitting operation is made easy, and it is thus possible to complete the tight-fitting operation in a short period of time and in an accurate manner, and thus, the operability of the board-to-board connector is improved.

Moreover, fitting surfaces 13*a*, 18 are flat, and none of the portions of first terminals 61 protrude out from fitting surfaces 13*a*, 18. Furthermore, fitting surfaces 118 of protrusive convex portions 112*a* are flat, and none of the portions of second terminals 161 protrude out from fitting surfaces 118. Owing to this configuration, it is possible to perform the positioning by moving second connector 101 to be smoothly slid relative to first connector 1.

Furthermore, when fitting surfaces 118 on either left or right side are brought into abutting contact with fitting surfaces 18 of side wall portions 14, fitting surfaces 118 of protrusive convex portions 112*a* on the other side make abutting contact with fitting surface 13*a* of protrusive convex portion 13. Owing to this configuration, fitting surfaces 118 of protrusive convex portions 112*a* on the left and right side can make abutting contact with fitting surface 13*a* of protrusive convex portion 13 and fitting surface 18 of side wall portions 14 while being prevented from being fitted into recessed groove portions 12*a*, and thus, it is possible to perform the positioning while preventing second connector 101 from being caught at first connector 1.

While a preferred embodiment of the Present Invention is shown and described, it is envisioned that those skilled in the art may devise various modifications without departing from the spirit and scope of the foregoing Description and the appended Claims.

What is claimed is:

1. A board-to-board connector, the board-to-board connector comprising:

a first connector, the first connector including a first housing, the first housing including:

first terminals mounted therein, an island portion, concave insertion portions formed at both sides of the island portion, side wall portions formed at both sides of each of the concave insertion portions, and concave bracket holding portions formed on portions of both ends of the side wall portions; and a second connector configured to be tightly fitted to the first connector, the second connector including a second housing, the second housing including:

second terminals contacting the first terminals, a recessed groove portion into which the island portion is inserted, and protrusive convex portions formed at both sides of the recessed groove portion to be inserted in the concave insertion portions;

wherein:

first stage fitting guides formed on inner ends of fitting surfaces of the side wall portions;

second stage fitting guides formed on portions of the fitting surfaces of the side wall portions at both ends of the side wall portions to be disposed outside the first stage fitting guides and surrounding the concave bracket holding portions;

the fitting surfaces of the side wall portions are at the same surface as a fitting surface of the island portion; and a distance from the second stage fitting guides on either left or right side to an opposite lateral surface of the island portion is longer than a distance from an outer lateral surface of each of the protrusive convex portions on either left or right side to an inner lateral surface of each of the protrusive convex portions on the other side.

2. The board-to-board connector according to claim 1, wherein the fitting surfaces of the side wall portions are flat.

3. The board-to-board connector according to claim 2, wherein the the island portion is flat.

4. The board-to-board connector according to claim 1, wherein when the fitting surfaces of the protrusive convex portions on the either left or right side are brought into abutting contact with the fitting surfaces of the side wall portions, the fitting surfaces of the protrusive convex portions on the other side make abutting contact with the fitting surface of the island portion.

5. The board-to-board connector according to claim 1, wherein the first stage fitting guides are chamfered portions formed in the inner ends of the fitting surfaces.

6. The board-to-board connector according to claim 5, wherein the second stage fitting guides are chamfered portions formed in inner ends of projecting portions formed on the fitting surfaces.

7. The board-to-board connector according to claim 6, wherein when the fitting surfaces of the protrusive convex portions on the either left or right side are brought into abutting contact with the fitting surfaces of the side wall portions, the fitting surfaces of the protrusive convex portions on the other side make abutting contact with the fitting surface of the island portion.

8. The board-to-board connector according to claim 1, wherein fitting surfaces of the protrusive convex portions are flat.

9. The board-to-board connector according to claim 8, wherein none of the portions of the first terminals protrude out from the fitting surfaces.

10. The board-to-board connector according to claim 8, wherein none of the portions of the second terminals protrude out from the fitting surfaces.

11. The board-to-board connector according to claim 10, wherein when the fitting surfaces of the protrusive convex portions on the either left or right side are brought into abutting contact with the fitting surfaces of the side wall portions, the fitting surfaces of the protrusive convex portions on the other side make abutting contact with the fitting surface of the island portion.

12. The board-to-board connector according to claim 10, wherein the first stage fitting guides are chamfered portions formed in the inner ends of the fitting surfaces.

13. The board-to-board connector according to claim 12, wherein the second stage fitting guides are chamfered portions formed in inner ends of projecting portions formed on the fitting surfaces.

14. The board-to-board connector according to claim 13, wherein when the fitting surfaces of the protrusive convex portions on the either left or right side are brought into abutting contact with the fitting surfaces of the side wall portions, the fitting surfaces of the protrusive convex portions on the other side make abutting contact with the fitting surface of the island portion.

* * * * *